United States Patent [19]

Taillandier

[11] Patent Number: 4,549,724

[45] Date of Patent: Oct. 29, 1985

[54] SELF-ORIENTABLE BARRIER FENCE

[76] Inventor: Jean-Michel Taillandier, La Cote, Herbeys, Eybens 38320, France

[21] Appl. No.: 385,386

[22] PCT Filed: Sep. 24, 1981

[86] PCT No.: PCT/FR81/00122

§ 371 Date: May 24, 1982

§ 102(e) Date: May 24, 1982

[87] PCT Pub. No.: WO82/01204

PCT Pub. Date: Apr. 15, 1982

[30] Foreign Application Priority Data

Sep. 25, 1980 [FR] France ..... 80 20793

[51] Int. Cl.[4] ..... E01F 7/02

[52] U.S. Cl. ..... 256/12.5; 104/279

[58] Field of Search ..... 256/13.1, DIG. 2, 13, 256/12.5; 104/279

[56] References Cited

U.S. PATENT DOCUMENTS

| | | | |
|---|---|---|---|
| 1,108,943 | 9/1914 | Swezey | 256/12.5 |
| 1,468,553 | 9/1923 | Bese . | |
| 1,721,894 | 7/1929 | Abbe . | |
| 1,857,762 | 5/1932 | Meadows . | |
| 2,193,062 | 3/1940 | Del Rea De Land | 47/26 |
| 2,646,257 | 7/1953 | Krume | 256/12.5 |
| 3,473,786 | 10/1969 | Luebke | 256/12.5 |
| 3,481,566 | 12/1969 | Littlejohn | 244/114 |
| 3,630,489 | 12/1971 | Cordell, Sr. | 256/12.5 |

FOREIGN PATENT DOCUMENTS

| | | |
|---|---|---|
| 361967 | 4/1981 | Austria . |
| 275856 | 12/1912 | Fed. Rep. of Germany . |
| 1054105 | 4/1959 | Fed. Rep. of Germany . |
| 1803624 | 10/1970 | Fed. Rep. of Germany . |
| 2817015 | 10/1978 | Fed. Rep. of Germany . |
| 358093 | 1/1906 | France . |
| 360584 | 4/1906 | France . |
| 537895 | 5/1922 | France . |
| 2133371 | 11/1972 | France . |
| 338854 | 7/1959 | Switzerland . |
| 14958 | of 1911 | United Kingdom . |
| 18344 | of 1915 | United Kingdom . |
| 173650 | 1/1922 | United Kingdom . |

OTHER PUBLICATIONS

Article-"How to use Fences to Prevent Roads Being Blocked by Snow" by W. I. J. Price, B. Sc.-published Jan. 1954-pp. 7-10.

"Plastic Anti-Dazzle Screens for Safety on Divided Highways", found in *Technological Digest* pp. 15-16; published Apr. 1964, digested from Zampini Salazar G. F.

*Primary Examiner*—Andrew V. Kundrat

*Attorney, Agent, or Firm*—Sandler & Greenblum

[57] ABSTRACT

A self-orientating barrier fence for use in controlling snow or sand drifts or other airborne particles which is rotatably mounted on a support in such a manner as to automatically direct itself into a position perpendicular to wind. The barrier fence may be positioned without regard to measurements of wind direction and may be removed when it is not needed.

12 Claims, 11 Drawing Figures

SELF-ORIENTABLE BARRIER FENCE

BACKGROUND OF THE INVENTION

The present invention relates to equipment called "for wind" whose object is to control the transport and deposit of pulverulent material, e.g., sand and snow.

In the field of snow, this transport is the cause of avalanches in upper mountain and the formation of drifts on the communication passages in middle mountain regions.

The conventional "wind" works are fixedly and immovably implanted in the conventional fence with respect to the orientation of the face of the fence to the wind. The conventional fence is maximally effective only when the apparatus is perpendicular to the direction of the wind.

Most of the time it is impossible, without resorting to continuous measures over several years, to know with precision the principal direction of the wind which causes drifts or mounds. Furthermore, it is possible that the wind may blow in several of directions causing disturbing phenomena in the deposit of the snow. Presently, the wind works or barrier fences are implanted in a empirical fashion on the terrain which may result in no barrier effect and may even result in detrimental effects such as the deposit of snow at a location where one wished to avoid it.

SUMMARY OF THE INVENTION

Accordingly, it is an object of the invention to overcome the foregoing disadvantages and to provide a barrier fence which is automatically positioned perpendicularly to the direction of the wind. It is a further object to provide a barrier fence which has the advantage of being implanted without regard to preliminary measures.

In accordance with the present invention, there is provided a barrier fence made of a support which rotatably rests within a foundation tube. Located on the support tube is a frame which comprises horizontally positioned wood planking separated in a lattice-like arrangement.

The principle of the invention is to offset the active portion, or auxiliary portion, of the barrier fence from its axis of rotation, thereby causing a parasitic coupling which tends to space the apparatus from an unstable equilibrium position of the wind vane type to bring it to a new stable equilibrium position which is perpendicular to the direction of the wind. It is in this position that the efficiency of a wind apparatus is maximized.

The self-orientatable wind works are divided into three groups e.g., wind barriers, wind directing panels and roof nozzles. The barriers and the panels are nearly identical. Only the wood planking differs, forming a square with 50% of the openings for the barriers and a small trapezoid side at the bottom with 10–30% of the openings for the panels.

The roof nozzle has the same metallic skeleton as the two previous apparatus, with the exception of a telescopic arm and of the planking which becomes rectangular, the small side being horizontal. The close similarity between the three barrier fences has a great advantage for the standardization of the barrier fences which, until now, were made to order on location, resulting in considerable increase of costs. With this new generation of barrier fences prefabrication becomes possible and competitive with respect to fixed apparatus. Furthermore, these barrier fences are easily disassemblable which was not the case until now. This advantage is less important for anti-avalanche purposes in the high mountains, but it becomes essential in the case of the anti-drift fight along the length of communication passages in the middle mountains. In this case, the farmers do not readily approve of implanting such apparatus on their property except on the condition that in the summer everything be removed to allow for example, for the the harvesting of hay. A removable stopper makes it possible to preserve the functional foundation tube for the next winter season.

In the case of protection of communication passages against drifts, the apparatus make it possible to achieve an economy over the length of the apparatus to be installed, this being equal to the length of the road, or of the train tracks to be protected, while the fixed apparatus must be physically positioned to account for different wind directions.

BRIEF DESCRIPTION OF DRAWINGS

The invention will now be described in greater detail with reference to the accompanying drawings; wherein.

Figure 1:
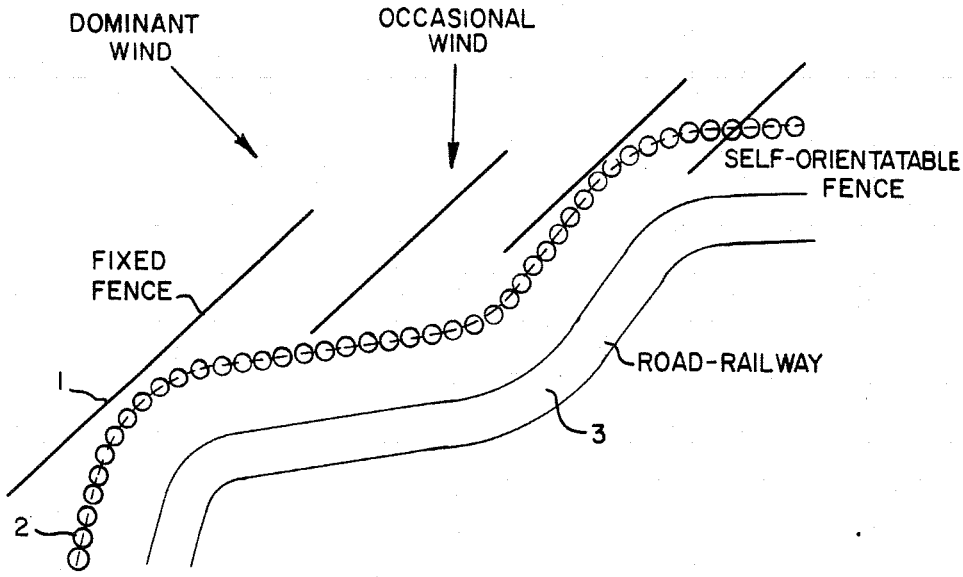
FIG. 1 is a plan view of the Self-Orientating Barrier Fence and of a series of permanent fences of the prior art positioned next to a communication passage.

Positioned on FIG. 1 are two types of fence: the fixed, permenant fence 1 of the prior art and the self-orientating fence 2 of the present invention. In order to protect a 180 mile communication passage 3, e.g., road or railway, from drifts formed by the dominant and occasional wind currents as shown by arrows on FIG. 1, approximately 250 miles of fixed fence 1 is necessary whereas only 180 miles of fence 2 is required.

Figure 2:
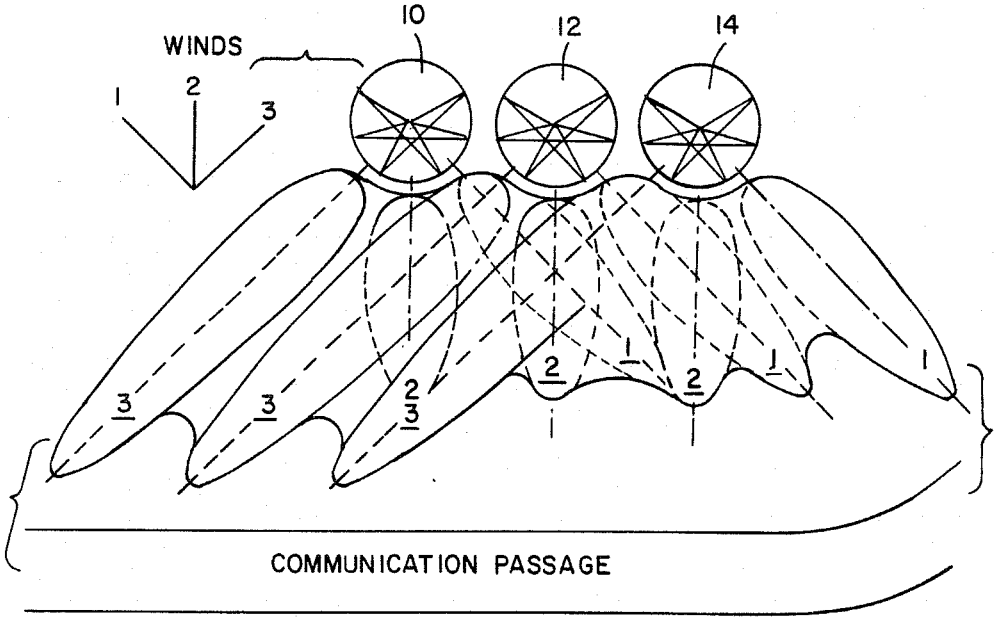
FIG. 2 is a plan view of a drift formation pattern.

In FIG. 2 are shown fence barriers 10, 12, 14. The self-orientating fence barriers 10, 12, 14 when used in small numbers may be, be preferably substituted for a campaign of measures with a view toward the installation of a system of fixed works. They thus serve as "drift" indicators.

At the end of winter, one notes the direction and the extent of the deposits caused by the element or elements.

In the drift pattern shown on FIG. 2, it is seen that the most disturbing wind is that which has formed drift No. 1.

The longevity of the fence barriers are increased by virtue of the variable ground guard which produces a "venturi" effect between the fence and the ground. Thus, the invention is never buried in the drift which it causes and never subjected to the packing and subsequent destructive action of the snow.

These works can also be utilized against sand winds and the formation of dunes.

Cultural experiences in desert environments are often compromised by the abrasive action of the sand transported by the wind. Young plants are destroyed even through appropriate irrigation would permit them to develop normally. The vegetable wind-breaks undergo the same outcome. The self-orientatable wind works would protect young trees from the destructive action of sand grains during the first years when they are very vulnerable.

All which has preceded constituted particularly preferred applications of this new generation of wind works.

DETAILED DESCRIPTION OF THE PREFERRED EMBODIMENT

As shown in FIGS. 4–8, each fence barrier comprises a vertical support 10 made of steel and highly resistant to low temperature. Although support 10 may be a fixed directly and permanently into a base structure. e.g., the ground or a roof, it is preferably set into a foundation tube 12, provided with funnel-like wing or chamber 14 which allows for the distribution of stresses in the ground. One can also take advantage of the anchorage technique in the ground soil by exploded stakes developed by the Nivologie division of the C.P.M.A.G.-R.E.F. of Grenoble. A removable stopper 16 makes is possible to preserve the functional foundation between two winter seasons. When the barrier fence is removed, stopper 16 plugs foundation tube 12 and preserves it until it is, again, ready to be used.

Figure 4:
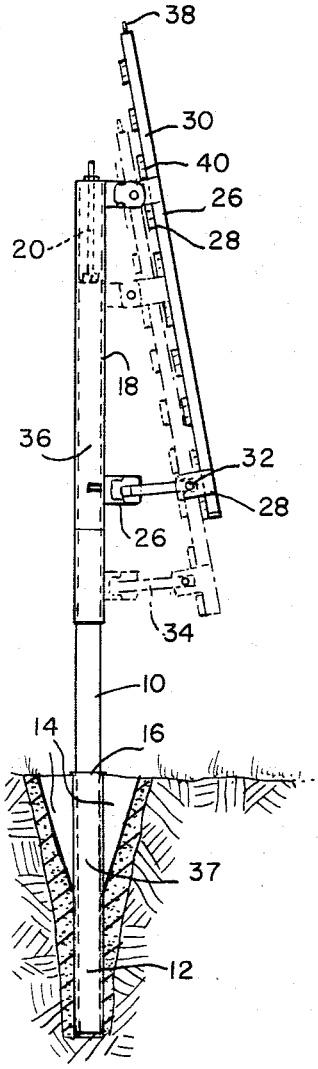
FIGS. 4 and 5 show a side and a front view of the principle embodiment of the present invention.
Figure 5:
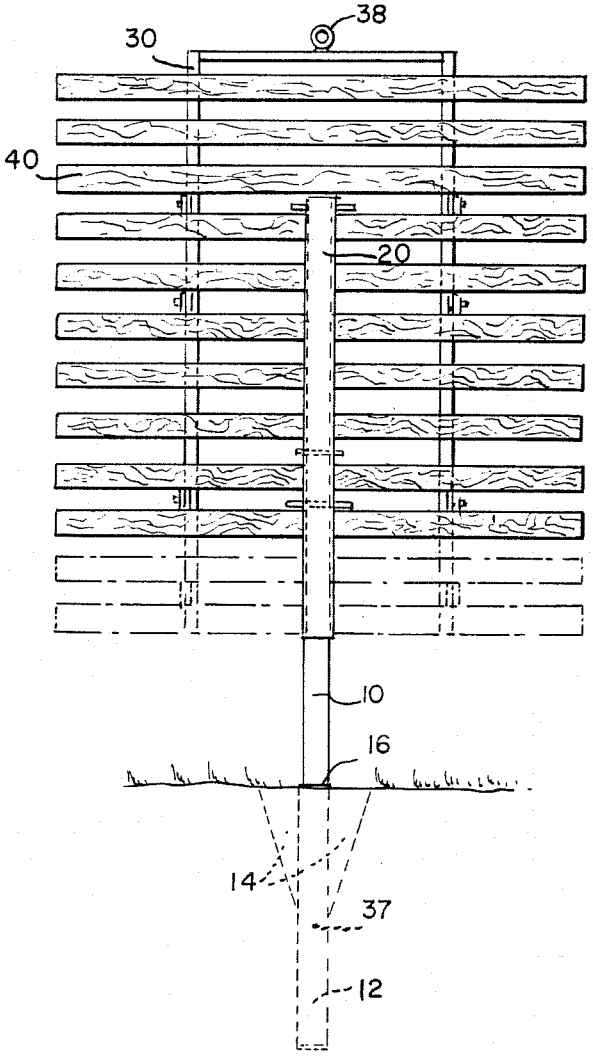
Figure 6:
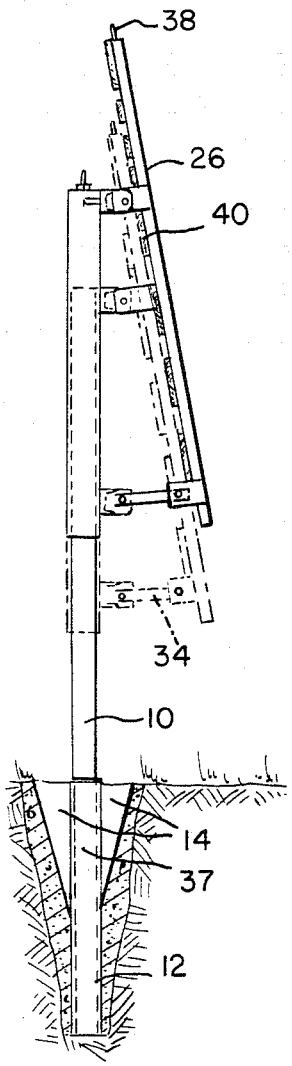
FIGS. 6 and 7 show a side and a front view of an alternative embodiment of the present invention.
Figure 8:
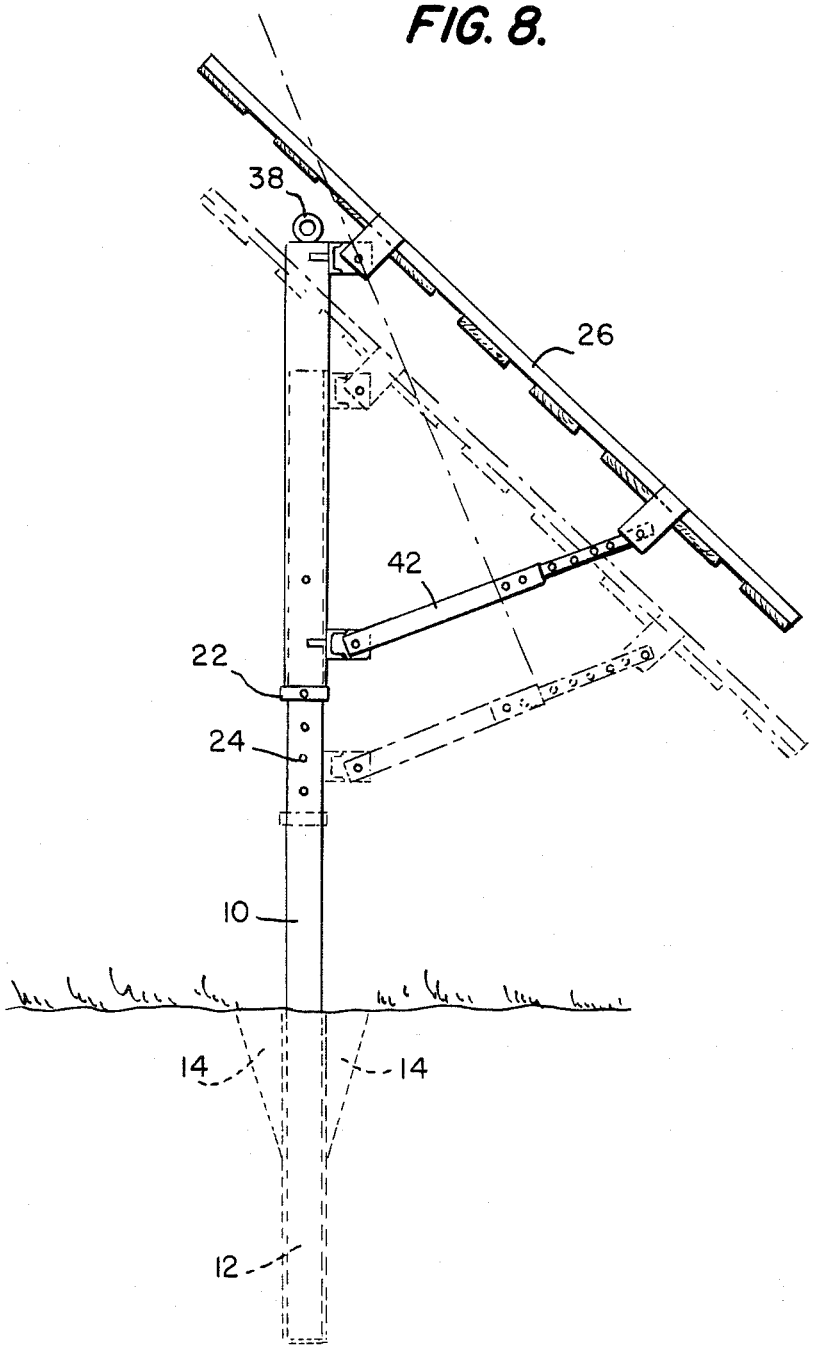
FIG. 8 shows a side view of yet another embodiment of the present invention.

Support tube 10 is capped by rotation tube 18 which is closed at its upper end to avoid the penetration of the elements, e.g., water, ice or snow. Rotation tube 18 is positioned vertically to endure a variable ground guard by a bolt-nut system 20 protected from the elements or a teflonring system 22, 24 or the like with an adjustment pin. As shown in FIG. 4 bolt-nut system 20 comprises a nut and an adjustable bolt which connect frame 30 to rotation tube 18. Frame 30 is connected to cross bars 26, which are integrally attached to pivoting tube 18 by caps or end pieces 28 and 32, caps 32 being integrally attached to frame 30 and caps 28 being integrally attached to cross bars 26. Shown in FIG. 8 is teflon ring system 22, 24 which is slidably attached to rotation tube 18. By raising or lowering ring system 22, 24, the angle of frame 30 which is attached thereto by means of extension rod 42 may be changed. The ring system 22 and 24 comprises a plastic ring 22 which slides vertically along the tube and which is thus adapted to protect the inner portion of the tube from weather and other elements. Tube 18 is supported within ring 22 and on tube 10. The variable ground guard allows the barrier fence to be used on terrains which are sloped as much as 80% from the horizontal. The slope of frame 30 with respect to cross bars 26 and tube 18 occurs by the adjustment of cross piece 34 (FIG. 6) or 42 (FIG. 8), which spaces cap or end piece 32 from cap or end piece 28. As can be seen clearly in FIG. 8, as the ring system 24 slides downwardly along tube 10, connecting member 42, which supports cross bars 26, will be pulled inwardly to change the slope of the framework. integrally attached to frame 30 and caps 28 being integrally attached to cross bars 26. For more sophisticated apparatus the rotation of the tube 18 can be assured by rollers or smooth machine bearings or rollers (not shown) which insures proper linkage between rotational tube 18 and support 10.

Attached to tube 18 are two arms 26, 28 provided with journal caps. A metallic frame 30 likewise provided with journal caps attaches itself on the arms 26,28 by means of bolts 32 and arms 34 allowing to incline frame 30 with respect to the vertical position. Arms 34 can be mounted on the base or at the apex of the metallic frame 30.

Removable pins 36,37 and a fixed buckle 38 allow for the transportation and the positioning of the entire assembly by means such as a helicopter or hoist along the length of communication passages.

Figure 7:
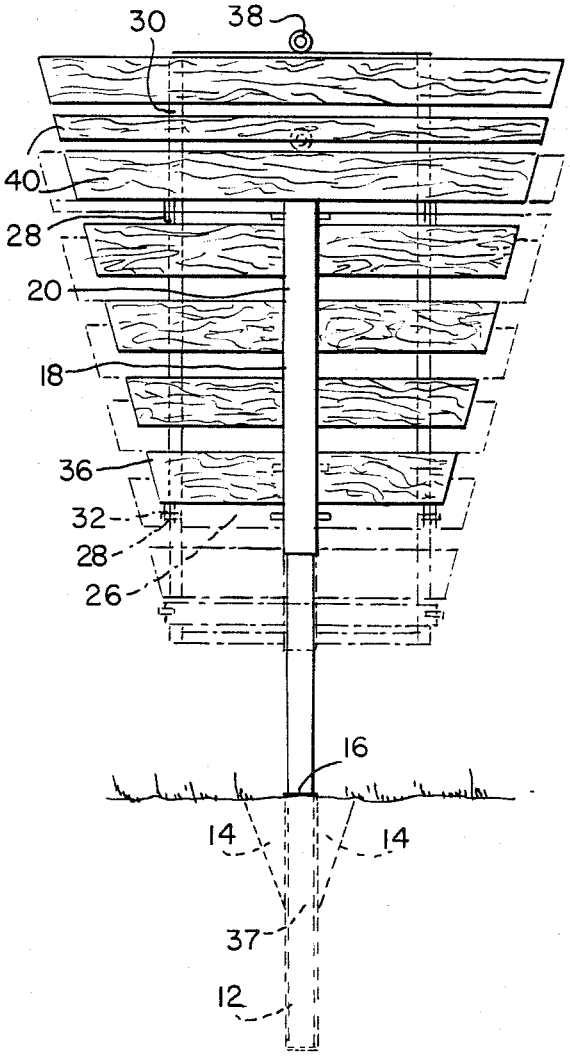

On the metallic frame 30 are attached by bolts the boards 40 with a percentage of openings varying from 40–60% for the barrier (FIGS. 4 and 5) and 10–30% for the wind directing panels (FIGS. 6 and 7) and the roof nozzle (FIG. 8). The wind direction panels are shaped in a variety of ways from square (FIG. 5) to trapezoidal (FIG. 7). Generally, the trapezoidal shape allows for use of the barriers on sloping terrains. The roof nozzle in FIG. 8 has a variable inclination with respect to the vertical which is obtained by means of telescopic arms 42 replacing arms 34 of other works.

Figures 3A, 3B, 3C, 3D:
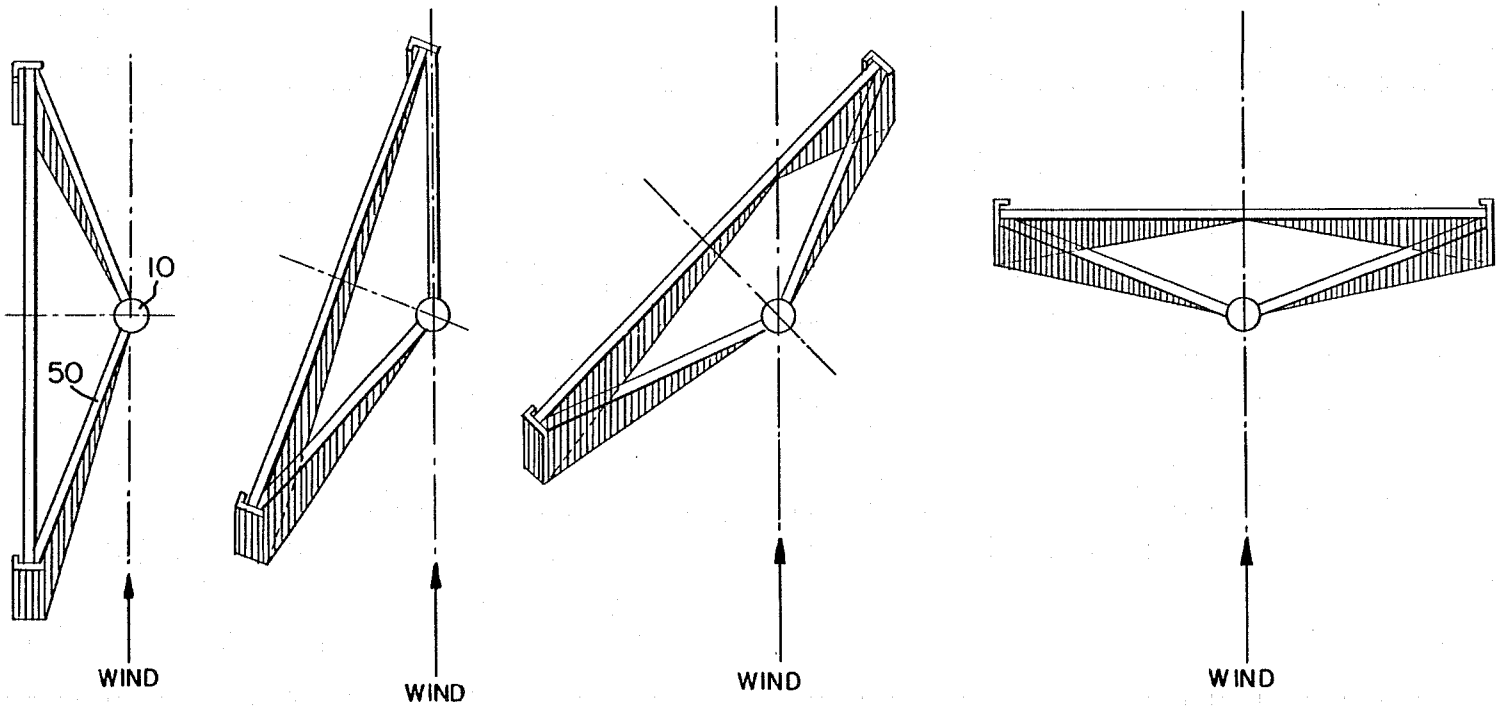
FIG. 3 is a schematic drawing showing how the barrier fence operates by wind current.

FIG. 3 shows in schematic form the positioning of the barrier fence by operation of wind. The wind is directed toward the angled supports 50, 52 thereby causing the barrier fence to rotate upon its support 10. (See Diagram 1). As shown in Diagrams 2 and 3, the force of the wind-directed rotation further exposes the board to the wind causing additional rotation until the fence is in a position which is generally perpendicular to the direction of the wind.

I claim:

1. A barrier fence for use in controlling airborne particles, said barrier fence comprising a frame and a plurality of boards connected to said frame, said boards being spaced from one another, and means for automatically positioning said fence continuously in any position about 360° and which is perpendicular to the direction of a wind current, said means for automatically positioning said fence comprising a support adapted to be connected to a base structure, a rotation tube mounted on said support, said rotation tube having a top end and a bottom end, wherein said frame is connected to said rotation tube, said rotation tube further comprising tilting means for altering the angle of said frame in accordance with the slope of terrain on which said barrier fence is placed.

2. A barrier fence according to claim 1 wherein said support is permanently connected to said base structure.

3. A barrier fence according to claim 1 wherein said support is removably connected to said base structure.

4. A barrier fence according to claim 3 wherein said base structure comprises a foundation tube for receiving said support, said foundation tube having a top end and a bottom end.

5. A barrier fence according to claim 4 wherein the diameter of said foundation tube top end of is wider than the diameter of said foundation tube bottom end.

6. A barrier fence according to claim 4 wherein said foundation tube includes a stopper, said stopper being adapted to plug said foundation tube top end when said support is removed therefrom.

7. A barrier fence according to claim 1 wherein said top end of said rotation tube is sealed.

8. A barrier fence according to claim 1 wherein said positioning means comprises a nut and an adjustable bolt which connect said frame to said rotation tube.

9. A barrier fence according to claim 1 wherein said tilting means comprises a teflon-ring system, said teflon-ring system comprising a teflon-ring slidably attached to said rotation tube, said rotation tube being connected to said frame by means of an extension rod.

10. A barrier fence according to claim 1 wherein said rotation tube further comprises a bearing system for insuring proper linkage between said foundation tube and said support.

11. A barrier fence according to claim 1 wherein said plurality of boards comprises wooden slats spaced from each other and located substantially horizontally.

12. A barrier fence for use in controlling airborne particles, and for detecting the direction and extent of a drift deposit of a pulverulant material, said deposit occurring as a result of wind, said fence comprising means for automatically positioning said fence continuously in a position perpendicular to the direction of a wind current at any time, said barrier fence comprising:

(a) a foundation tube, sai foundation tube having a top end and a bottom end, said top end being wider in diameter than said bottom end;

(b) a support, said support being removably positioned within said foundation tube, (c) a rotation tube, said rotation tube being rotatably mounted on said support;

(d) a metallic frame, said frame being attached to said rotation tube by tilting means allowing said frame to be inclined at varying angles with respect to the slope of the terrain;

(e) means for detachably securing said rotation tube to said support said means comprising at least one pin, said pin being removably connected to said rotation tube; and (f) a plurality of slats spaced from each other and located substantially horizontally.

* * * * *

UNITED STATES PATENT AND TRADEMARK OFFICE

CERTIFICATE OF CORRECTION

PATENT NO. : 4,549,724

DATED : October 29, 1985

INVENTOR(S) : Jean-Michel TAILLANDIER

It is certified that error appears in the above-identified patent and that said Letters Patent is hereby corrected as shown below:

At column 2, line 10, delete "the" (second occurrence);
At column 2, line 14, change "the" to ---these---;
At column 2, line 38, change "permenant" to ---permanent---;
At column 2, line 47 of the printed patent, delete "be,",
At column 2, line 68 of the printed patent, change "through" to ---though---;
At column 3, line 22 of the printed patent, change "is" to ---it---;
At column 3, line 14 of the printed patent, change "a fixed" to ---affixed---;
At column 3, line 32 of the printed patent, change "teflonring" to ---teflon ring---;
At column 3, line 68 of the printed patent, insert ---this--- before "frame";
At column 4, line 53, delete "of" (second occurrence);
At column 4, line 65, delete "-" (both occurrences);
At column 4, line 66, delete "-"; and
At column 6, line 1, change "sai" to --- said---.

Signed and Sealed this

*Sixth* Day of *May 1986*

[SEAL]

*Attest:*

DONALD J. QUIGG

*Attesting Officer*

*Commissioner of Patents and Trademarks*